US009564281B2

(12) United States Patent
Gilman et al.

(10) Patent No.: US 9,564,281 B2
(45) Date of Patent: Feb. 7, 2017

(54) FUSE END CAP WITH CRIMPABLE TERMINAL

(71) Applicant: LITTELFUSE, INC., Chicago, IL (US)

(72) Inventors: Daniel R. Gilman, Chicago, IL (US); Thomas M. Novak, Tolono, IL (US); Nathan C. Siegwald, Tolono, IL (US)

(73) Assignee: Littelfuse, Inc., Chicago, IL (US)

( * ) Notice: Subject to any disclaimer, the term of this patent is extended or adjusted under 35 U.S.C. 154(b) by 504 days.

(21) Appl. No.: 13/851,296

(22) Filed: Mar. 27, 2013

(65) Prior Publication Data

US 2013/0257580 A1 Oct. 3, 2013

Related U.S. Application Data

(60) Provisional application No. 61/615,983, filed on Mar. 27, 2012.

(51) Int. Cl.
*H01H 85/157* (2006.01)
*H01H 1/58* (2006.01)
*H01H 85/20* (2006.01)

(52) U.S. Cl.
CPC ..... *H01H 85/157* (2013.01); *H01H 1/5866* (2013.01); *H01H 85/201* (2013.01)

(58) Field of Classification Search
CPC . H01H 1/5866; H01H 85/157; H01H 85/0418
USPC ..... 337/180, 181, 187, 191, 248, 251, 252,337/268
See application file for complete search history.

(56) References Cited

U.S. PATENT DOCUMENTS

| | | | | | |
|---|---|---|---|---|---|
| 2,172,226 | A | * | 9/1939 | Smith | 337/240 |
| 2,259,053 | A | * | 10/1941 | Xenis | 337/159 |
| 2,282,279 | A | * | 5/1942 | Xenis | 337/291 |
| 2,414,865 | A | * | 1/1947 | Genter | 337/191 |
| 2,668,211 | A | * | 2/1954 | Matthysse | 337/192 |
| 2,839,636 | A | * | 6/1958 | Brown | 337/192 |
| 3,085,138 | A | | 4/1963 | Brown et al. | |
| 3,222,482 | A | * | 12/1965 | Hitchcock | 337/252 |
| 4,280,748 | A | * | 7/1981 | McHenney et al. | 439/620.26 |
| 4,540,969 | A | * | 9/1985 | Sugar | 337/232 |
| 4,613,195 | A | * | 9/1986 | Suher et al. | 439/166 |
| 4,720,695 | A | * | 1/1988 | Urani et al. | 337/254 |

(Continued)

FOREIGN PATENT DOCUMENTS

| | | | |
|---|---|---|---|
| EP | 0042332 | A1 | 12/1981 |
| WO | 8400078 | A1 | 1/1984 |
| WO | 2011125019 | A1 | 10/2011 |

OTHER PUBLICATIONS

Baichtal, J., "Make: Heat Shrink Fuse Holder", Makezine Online Blog. Dec. 4, 2010 [Retrieved Jun. 10, 2013]. Retrieved from Internet;,URL:http://blog.makezine.com/2010/12/04/heat-shrink-fuse-holder/> (six (6) pages).

(Continued)

*Primary Examiner* — Anatoly Vortman

(57) ABSTRACT

A fuse end cap for providing an electrical connection between a fuse and an electrical conductor. The fuse end cap may include a mounting cuff defining a first cavity that is adapted to receive a fuse body. The mounting cuff may be configured to be mounted to the fuse body by friction fit, for example. The fuse end cap may further include a terminal defining a second cavity adapted to receive a conductor. The terminal may be configured to be crimped about the conductor to retain the conductor within the second cavity.

20 Claims, 6 Drawing Sheets

(56) References Cited

U.S. PATENT DOCUMENTS

| | | | | |
|---|---|---|---|---|
| 4,734,059 | A | 3/1988 | Melugin | |
| 4,752,760 | A * | 6/1988 | Clark | 337/248 |
| 4,851,806 | A * | 7/1989 | Rohrer et al. | 337/231 |
| 4,909,761 | A | 3/1990 | Muguira | |
| 5,722,473 | A | 3/1998 | Tucker | |
| 5,736,918 | A * | 4/1998 | Douglass | 337/186 |
| 5,882,229 | A * | 3/1999 | Caren et al. | 439/620.26 |
| 6,046,665 | A * | 4/2000 | Oh et al. | 337/191 |
| 6,317,307 | B1 | 11/2001 | Bone et al. | |
| 7,358,845 | B2 * | 4/2008 | Moffat | 337/237 |
| 7,515,031 | B2 * | 4/2009 | Jakobsen et al. | 337/187 |
| 7,532,102 | B2 * | 5/2009 | Lu | 337/191 |
| 7,639,113 | B2 * | 12/2009 | Heller | 337/168 |
| 8,242,874 | B2 * | 8/2012 | Pavlovic et al. | 337/187 |
| 2007/0019351 | A1 | 1/2007 | Whitney et al. | |
| 2011/0125019 | A1 | 5/2011 | Shiina et al. | |

OTHER PUBLICATIONS

International Search Report and Written Opinion mailed Jun. 25, 2013, for corresponding PCT/2013/034028 filed Mar. 27, 2013 (11 pages).

Supplementary European Search Report dated from corresponding European Patent Application No. 13767405.7, Sep. 29, 2015.

* cited by examiner

FUSE END CAP WITH CRIMPABLE TERMINAL

FIELD OF THE DISCLOSURE

Embodiments of the invention relate to the field of circuit protection devices. More particularly, the present invention relates to a fuse end cap having a crimpable terminal for providing a secure electrical connection between a conductor and a fuse.

BACKGROUND OF THE DISCLOSURE

Fuses have long been used in electrical devices for providing an interruptible electrical connection between a source of electrical power and a component in an electrical circuit that is to be protected. For example, upon the occurrence of an overcurrent condition in a circuit, such as may result from a short circuit or other sudden electrical surge, an element within in the fuse may separate and interrupt the flow of electrical current to a protected circuit component, thereby preventing or mitigating damage to the component that would otherwise result if the overcurrent condition were allowed to persist.

Fuses may be disposed between a source of electrical power and a component in an electrical circuit by conductive wires, for example. These wires may be connected to respective ends of the fuse by soldering, welding, etc. Unfortunately, these methods of attaching wires to a fuse may generate excessive heat that can damage the internal components of the fuse, namely the fuse element. In addition, soldering of the wires to the fuse ends is prone to inconsistent manufacturing methods thereby compromising the electrical conductivity between the wires and fuse as well as susceptibility to disconnection. Moreover, prior fuse connections may have required separate components such as, for example, fuse-holders and/or fuseblocks which occupy valuable circuit real estate as well as adding to circuit complexity. Accordingly, there is a need for an improved fuse end cap that provides a more robust electrical connection mechanism between a fuse and wire connections without the need to additional components that avoids soldered, welded.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

Various embodiments of the present disclosure are generally directed to a fuse end cap for providing an electrical connection between a fuse and an electrical conductor. An exemplary fuse end cap in accordance with the present disclosure may include a mounting cuff defining a first cavity that is adapted to receive a fuse body. The mounting cuff may be configured to be mounted to the fuse body by friction fit, for example. The fuse end cap may further include a terminal defining a second cavity adapted to receive a conductor. The terminal may be configured to be crimped about the conductor to grip and retain the conductor within the second cavity.

An exemplary fuse assembly in accordance with the present disclosure may include a first fuse end cap including a mounting cuff defining a first cavity and a terminal defining a second cavity. The fuse assembly may further include a second fuse end cap including a mounting cuff defining a first cavity and a terminal defining a second cavity. The fuse assembly may further include a fuse having a fuse body with a first end mounted within the first cavity of the first fuse end cap and a second end mounted within the first cavity of the second fuse end cap. The fuse assembly may further include a first conductor having an end disposed within the second cavity of the first fuse end cap, wherein the terminal of the first fuse end cap is crimped about the end of the first conductor to secure the end of the first conductor within the second cavity of the first fuse end cap. The fuse assembly may further include a second conductor having an end disposed within the second cavity of the second fuse end cap, wherein the terminal of the second fuse end cap is crimped about the end of the second conductor to secure the end of the second conductor within the second cavity of the second fuse end cap.

BRIEF DESCRIPTION OF THE DRAWINGS

By way of example, specific embodiments of the disclosed device will now be described, with reference to the accompanying drawings, in which.

DETAILED DESCRIPTION

Figure 1A:
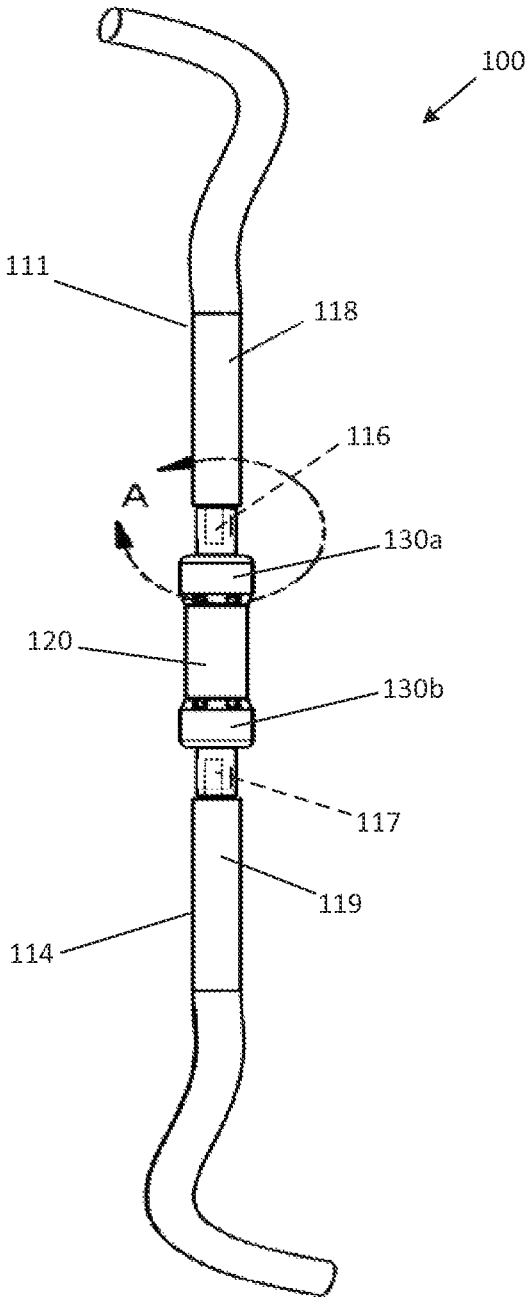
FIG. 1A is a side view illustrating an exemplary embodiment of an inline fuse assembly in accordance with the present disclosure.

The present invention will now be described more fully hereinafter with reference to the accompanying drawings, in which preferred embodiments of the invention are shown. This invention, however, may be embodied in many different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout.

FIG. 1A illustrates an exemplary embodiment of an inline fuse assembly 100 in accordance with the present disclosure. For the sake of convenience and clarity, terms such as "front," "rear," "top," "bottom," "up," "down," "inwardly," "outwardly," "lateral" and "longitudinal" will be used herein to describe the relative placement and orientation of components of the fuse assembly 100, each with respect to the geometry and orientation of the fuse assembly 100 as it appears in FIG. 1A. Said terminology will include the words specifically mentioned, derivatives thereof, and words of similar import.

The fuse assembly 100 may include a fuse 120, a pair of wires or cables 111 and 114 (hereinafter referred to as "the wires 111 and 114"), and a pair of electrically conductive end caps 130*a* and 130*b* that electrically couple the wires 111 and 114 to the fuse 120 as further described below. The wires 111 and 114 may provide an electrical connection between the fuse 120 and various other circuit elements (not shown) for which the fuse 120 may provide protection against certain overcurrent conditions. The wires 111 and 114 may include respective conductors 116 and 117 and respective insulating jackets 118 and 119 surrounding the conductors 116 and 117. Alternatively, it is contemplated that the one or both of the insulating jackets 118 and 119 may be omitted and that the wires 111 and 114 may include only bare conductors 116 and 117. The conductors 116 and 117 may be formed of any suitable, electrically conductive material, including, but not limited to, copper, aluminum, brass, gold, silver, or other metallic conductors. The insulating jackets 118 and 119 may be formed of any suitable, insulating material, including, but not limited to, polyethylene, polyvinyl chloride (PVC), polypropylene, TEFLON, and the like.

Figure 1B:
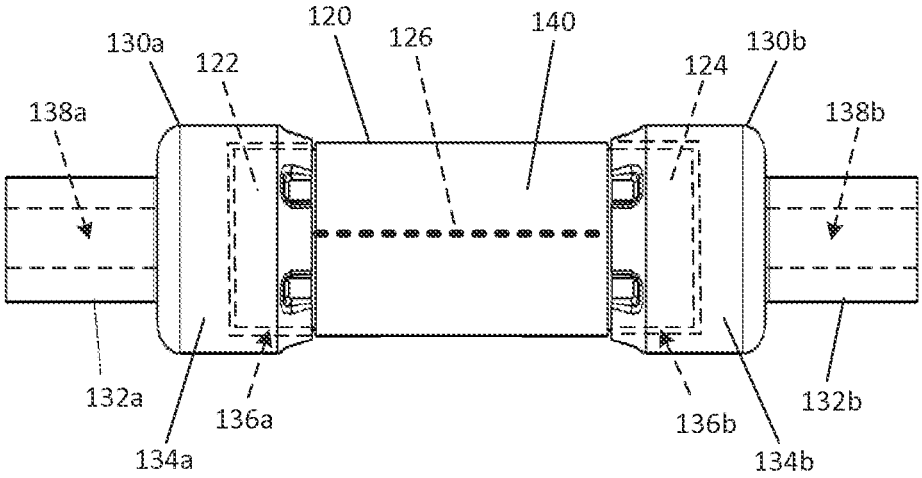
FIG. 1B is detail view illustrating the fuse assembly shown in FIG. 1A.

Referring to the enlarged view of the fuse 120 in FIG. 1B, the fuse 120 may include a fuse body 140 having a pair of electrically conductive end caps 130*a* and 130*b* that are electrically connected to one another by a fusible element 126 that extends through the fuse body 140. The fuse body 140 of the fuse 120 may be formed of any suitable, electrically insulating material, including, but not limited to, glass, ceramic, plastic, and the like. The end caps 130*a*, 130*b* may be formed of any suitable, electrically conductive material, including, but not limited to, copper, aluminum, brass, gold, silver, or other metallic conductors. The fusible element 126 may be formed of any suitable, electrically conductive material, including, but not limited to, copper, tin, nickel, and the like, and may be formed as a ribbon, wire, metal link, spiral wound wire, film, electrically conductive core deposited on a substrate, or any other suitable structure that is configured to separate or otherwise break the electrical connection between the end caps 130*a* and 130*b* upon the occurrence of an overcurrent condition. As will be appreciated by those of ordinary skill in the art, the particular size, volume, configuration, and conductive material comprising the fusible element 126 may all contribute to the rating of the fuse 120.

Each end cap 130*a* and 130*b* of the fuse assembly may include respective mounting cuffs 134*a* and 134*b* and respective crimpable terminals or tubes 132*a* and 132*b* (hereafter referred to as "the terminals 132*a* and 132*b*") that extend longitudinally outwardly from the respective mounting cuffs 134*a* and 134*b*. The terminals 132*a* and 132*b* may be coaxial with the mounting cuffs 134*a* and 134*b*, but this is not critical. The mounting cuffs 134*a* and 134*b* may have respective cavities 136*a* and 136*b* formed in the inwardly-facing sides thereof, wherein each cavity 136*a* and 136*b* has a size and a shape that is configured to matingly receive one the respective ends 122 and 124 of the fuse body 140 in a close clearance relationship therewith. For example, the ends 122 and 124 may be longitudinally inserted entirely or partially into the respective cavities 136*a* and 136*b* and may be securely held within the cavities 136*a* and 136*b* by friction fit, snap fit, or interference fit. Alternatively or additionally, the ends 122 and 124 may be securely held within the respective cavities 136*a* and 136*b* by various adhesives, such as conductive epoxy, or by various mechanical fasteners. In any case, the ends 122 and 124 may be disposed securely within the mounting cuffs 134*a* and 134*b*.

Figure 1C:
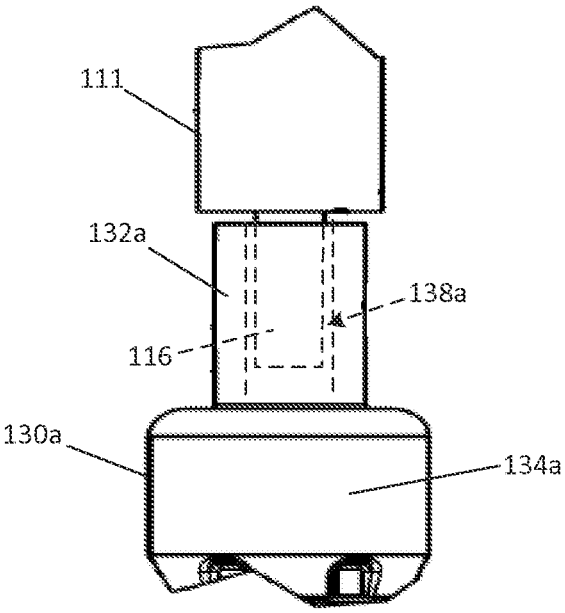
FIG. 1C is an enlarged view of Section A of the inline fuse assembly of FIG. 1A detailing an end cap in accordance with an embodiment of the present disclosure.

The terminals 132*a* and 132*b* of the end caps 130*a* and 130*b* may be substantially tubular members having respective cavities 138*a* and 138*b* formed therein. The cavities 138*a* and 138*b* may extend longitudinally through the entire lengths of the respective terminals 132*a* and 132*b* (as in FIG. 1B), or may extend only partially through the terminals 132*a* and 132*b* from the outwardly-facing sides of the terminals 132*a* and 132*b* longitudinally toward the respective mounting cuffs 134*a* and 134*b*. The cavities 138*a* and 138*b* may each have a size and a shape that are adapted to receive the ends of the respective conductors 116 and 117 of the wires 111 and 114 (as shown in FIG. 1C). Particularly, a portion of the insulating jackets 118 and 119 may be stripped from the ends of the respective conductors 116 and 117 and the stripped ends may be longitudinally inserted into the cavities 138*a* and 138*b*. Of course, if the wires 111 and 114 include only bare conductors 116 and 117, no stripping will be necessary.

FIG. 1C is a detail view illustrating the connective juncture of the conductive end cap 130*a* and the wire 111. This juncture will now be described in detail. It will be understood that such description shall also apply to the substantially identical juncture of the end cap 130*b* and the wire 114. As described above, the stripped end of the conductor 116 may be longitudinally inserted into the cavity 138*a* of the terminal 132*a*. Once the conductor 116 has been inserted thusly, the terminal 132*a*, which may be formed of a malleable material as further described below, may be crimped, crushed, bent, flattened, or otherwise deformed (hereinafter collectively referred to as "crimped") so as to pinch and securely trap the end of the conductor 116 therein. Depending on the rigidity of the terminal 132*a*, the terminal 132*a* may be crimped using a manual tool (e.g. pliers), by hand (e.g. manually pinched between fingers), or by various automated means. The conductor 116 may thereby be held in firm engagement with the terminal 132*a*, and a secure electrical connection may be established therebetween without requiring additional fasters, adhesives, or the application of solder.

The mounting cuffs 134*a* and 134*b* may be formed from any suitable, electrically conductive material, including, but not limited to, copper, aluminum, brass, gold, silver, and the like. The terminals 132*a* and 132*b* may also be formed from any suitable, electrically conductive material, including, but not limited to, copper, aluminum, brass, gold, silver, and the like, and may also be sufficiently malleable to facilitate crimping in the manner described above. Such malleability may be achieved through selection of a particularly malleable conductive material (e.g. gold) and/or by making the sidewalls of the terminals 132*a* and 132*b* sufficiently thin so as to facilitate deformation thereof.

It is contemplated that the end caps 130*a* and 130*b* may be produced by forming the mounting cuffs 134*a* and 134*b* and the respective terminals 132*a* and 132*b* separately from one another (e.g. from separate pieces of material) and subsequently joining them together. Alternatively, it is contemplated that each of the end caps 130*a* and 130*b*, including the respective mounting cuffs 134*a* and 134*b* and respective terminals 132*a* and 132*b*, may be formed from a single piece of material. Non-limiting examples of both embodiments of the end caps 130*a* and 130*b* (i.e. formed by both separate and unitary construction) are depicted in FIGS. 2A-4B, which are described in detail below.

Figure 2A:
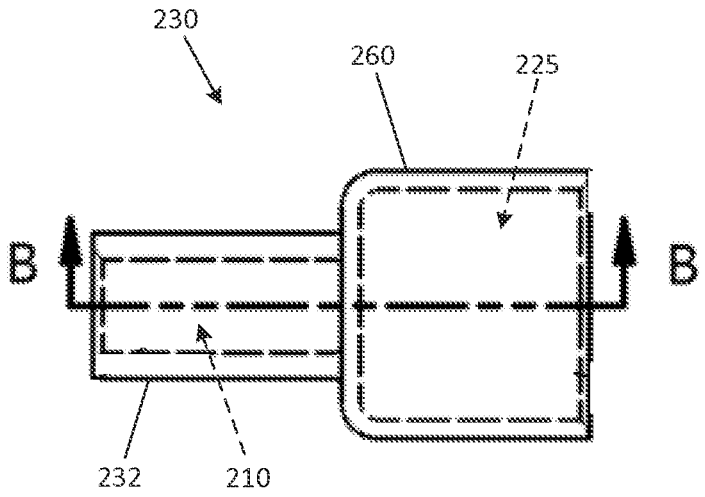
FIG. 2A is a side view illustrating a machined end cap in accordance with an embodiment of the present disclosure.
Figure 2B:
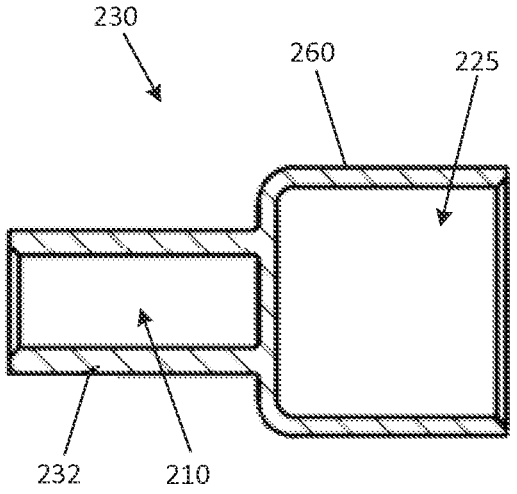
FIG. 2B is a cross section view of FIG. 2A taken along the line B-B.

FIGS. 2A and 2B respectively illustrate a side view and a cross-section view of a machined end cap 230. The end cap 230 is substantially similar to the end caps 130*a* and 130*b* described above, and may be implemented in the fuse assembly 100 in the same manner as the end caps 130*a* and 130*b*. Like the end caps 130*a* and 130*b*, the end cap 230 may have a mounting cuff 260 having a cavity 225 formed therein for matingly receiving one of the ends 122 and 124 of the fuse body 140 as discussed above with reference to FIG. 1B. Also like the end caps 130*a* and 130*b*, the end cap 230 may have a crimpable terminal 232 that extends longitudinally from the mounting cuff 260 and has a cavity 210 formed therein for accepting a stripped end of one of the conductors 116 and 117 of the wires 111 and 114 as discussed above with reference to FIG. 1C.

The end cap 230 may be formed from a single piece of any suitable, electrically conductive material, including, but not limited to, copper, aluminum, brass, gold, or other metallic conductors. Particularly, mounting cuff 260, cavity 225, crimpable terminal 232, and cavity 210 may be created by machining, cold heading, or otherwise forming (collectively referred to herein as "machining") such features from a single piece, blank, slug, or block of conductive material, such as by using a drill press, saw, lathe, computer numerical control (CNC) machine, milling machine, cold header, part former, etc.

Figure 3A:
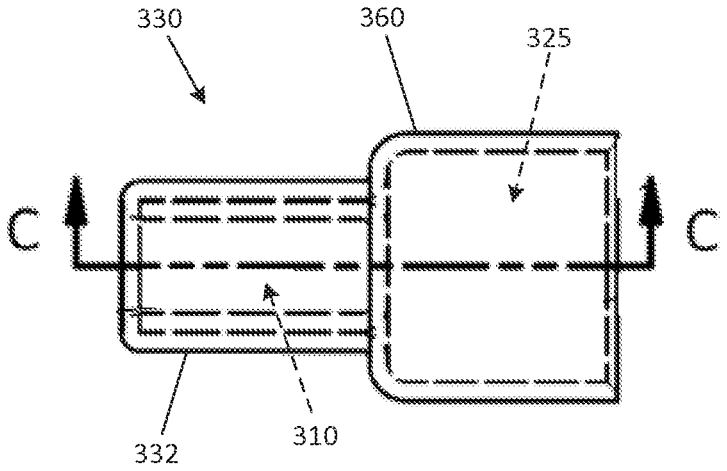
FIG. 3A is a side view illustrating a stamped end cap in accordance with an embodiment of the present disclosure.
Figure 3B:
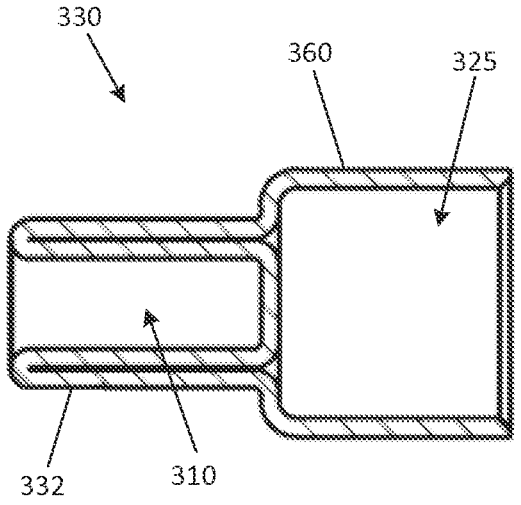
FIG. 3B is a cross section view of FIG. 3A taken along the line C-C.

FIGS. 3A and 3B respectively illustrate a side view and a cross-section view of a stamped end cap 330. The end cap 330 is substantially similar to the end caps 130*a* and 130*b* described above, and may be implemented in the fuse assembly 100 in the same manner as the end caps 130*a* and 130*b*. Like the end caps 130*a* and 130*b*, the end cap 330 may have a mounting cuff 360 having a cavity 325 formed therein for matingly receiving one of the ends 122 and 124 of the fuse body 140 as discussed above with reference to FIG. 1B. Also like the end caps 130*a* and 130*b*, the end cap 330 may have a crimpable terminal 332 that extends longitudinally from the mounting cuff 360 and has a cavity 310 formed therein for accepting a stripped end of one of the conductors 116 and 117 of the wires 111 and 114 as discussed above with reference to FIG. 1C.

The end cap 330 may be formed from a single piece of any suitable, electrically conductive material, including, but not limited to, copper, aluminum, brass, gold, or other metallic conductors. However, unlike the end cap 230 described above, the end cap 330 may be stamped (as opposed to machined) from a single piece (e.g. sheet) of conductive material. Particularly, the mounting cuff 360, cavity 325, crimpable terminal 332, and cavity 310 may be created by bending, folding, and pressing a sheet of conductive material using tools and process that will be familiar to those of ordinary skill in the art.

Figure 4A:
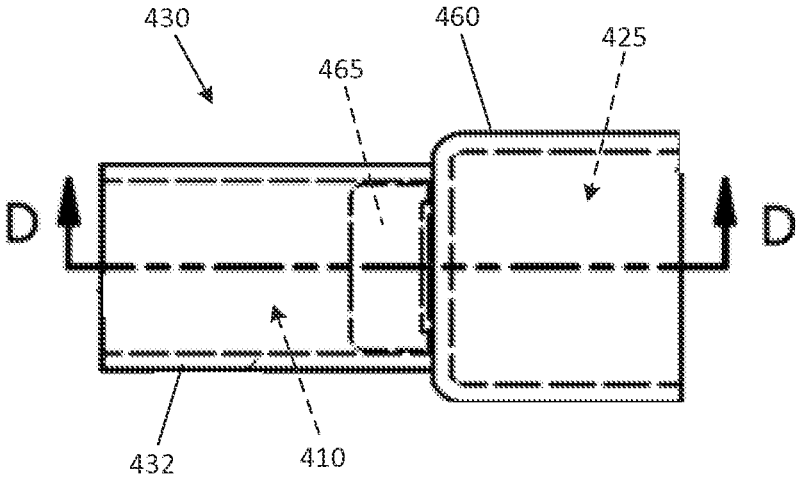
FIG. 4A is a side view illustrating an assembled end cap in accordance with an embodiment of the present disclosure.
Figure 4B:
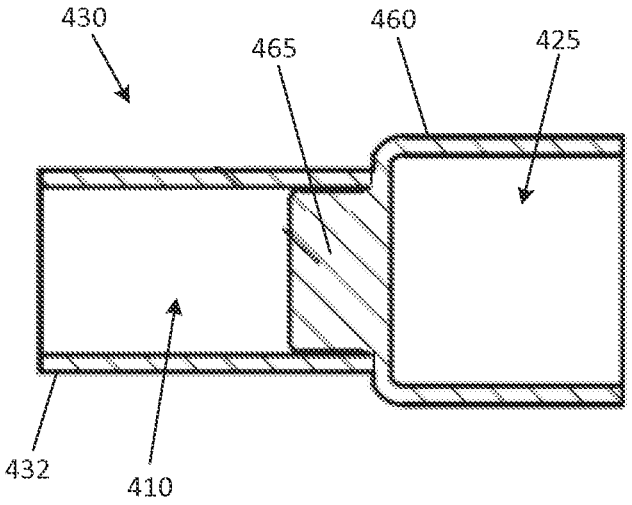
FIG. 4B is a cross section view of FIG. 4A taken along the line D-D.

FIGS. 4A and 4B respectively illustrate a side view and a cross-section view of an assembled end cap 430. The end cap 430 is substantially similar to the end caps 130*a* and 130*b* described above, and may be implemented in the fuse assembly 100 in the same manner as the end caps 130*a* and 130*b*. Like the end caps 130*a* and 130*b*, the end cap 430 may have a mounting cuff 460 having a cavity 425 formed therein for matingly receiving one of the ends 122 and 124 of the fuse body 140 as discussed above with reference to FIG. 1B. Also like the end caps 130*a* and 130*b*, the end cap 430 may have a crimpable terminal 432 that extends longitudinally from the mounting cuff 460 and has a cavity 410 formed therein for accepting a stripped end of one of the conductors 116 and 117 of the wires 111 and 114 as discussed above with reference to FIG. 1C. The mounting cuff 460 of the end cap 430 may further include a fastening stem 465 (described in greater detail below) projecting from a side of the mounting cuff 460 opposite the cavity 425.

Unlike the end caps 230 and 330 described above, the end cap 430 may be formed from two separate pieces of any suitable, electrically conductive material, including, but not limited to, copper, aluminum, brass, gold, or other metallic conductors that are joined together. Particularly, the mounting cuff 460 of the end cap 430 may be machined, stamped, or otherwise formed from one or more pieces of conductive material, and the terminal 432 of the end cap 430 may be machined, stamped, or otherwise formed from one or more separate pieces of conductive material. After the mounting cuff 460 and the terminal 432 have been formed thusly, they may be joined together, such as by press-fitting the fastening stem 465 of the mounting cuff 460 into the cavity 410 of the terminal 432 as shown in FIG. 4B. Of course, it is contemplated that the mounting cuff 460 and the terminal 432 may be joined together using variety of other fastening means, including, but not limited to, various adhesives, various mechanical fasteners, or welding.

It will be understood by those of ordinary skill in the art that the end caps 230-430 described above are set forth by way of example only, and that there exist various other, similar end cap embodiments that may be produced using a variety of different manufacturing methods. It is contemplated that all such end cap embodiments may be implemented in the fuse assembly 100 in the manner of the end caps 130*a* and 130*b* described above without departing from the present disclosure.

Figure 5:
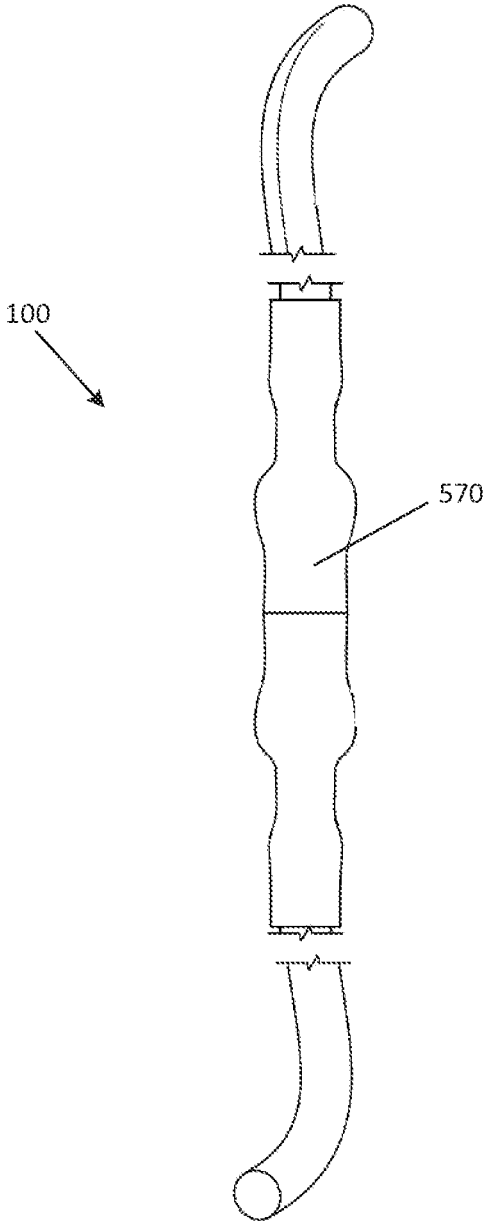
FIG. 5 is a side view illustrating the inline fuse assembly of FIG. 1A having a protective wrapping in accordance with an embodiment of the present disclosure.

Referring to FIG. 5, it is contemplated that the inline fuse assembly 100 of FIG. 1A may include a protective wrapping or coating 570 (hereinafter referred to as "the protective wrapping 570") surrounding the fuse 120, end caps 130*a* and 130, and end portions of the wires 111 and 114 (not within view). The protective wrapping 570 may be made of a thermoplastic material, including, but not limited to, polyolefin, fluoropolymer, PVC, neoprene, silicone elastomer, VITON, etc. In addition, the protective wrapping 570 may be heat-shrinkable, such that when heat is applied to the protective wrapping 570 (e.g. after it has been wrapped around the fuse assembly 100) it will decrease in size and will fit tightly over the fuse 120, end caps 130*a* and 130, and wires 111 and 114.

The protective wrapping 570 may provide the fuse 120, end caps 130*a* and 130*b*, and wires 111 and 114 with protection against abrasion and other potentially damaging contact. In addition, the protective wrapping 570 may provide a liquid-tight and/or airtight seal around the fuse assembly 100, thereby protecting the fuse assembly 100 from environmental elements such as water, grease, oil, dirt, dust, etc., which might otherwise enter the fuse assembly 100 and cause corrosion and/or degradation of performance. Still further, the protective wrapping 570 may electrically insulate all current carrying components of the fuse assembly 100 and may provide some degree of ultraviolet (UV) protection.

In another embodiment of the fuse assembly 100, it is contemplated that an over-molding or molded housing (not shown) may be disposed over the protective wrapping 570, proximate the fuse 120 and/or over the entire fuse assembly 100, for providing further protection against damage and environmental elements. Such an over-molding may be injection molded and may be made from plastic, rubber, or other durable, wear-resistant materials.

The end caps 130*a* and 130*b* described herein thus eliminate the need for traditional fuse holders and fuse blocks by providing convenient means for attaching conductive wires directly to a fuse. Furthermore, the end caps 130*a* and 130*b* mitigate the possibility of damaging internal components of a fuse when attaching conductive wires thereto, such as may otherwise occur if traditional means of attachment, such as welding or soldering, are employed. Still further, the end caps 130*a* and 130*b* improve the wire retention capability of a fuse assembly by eliminating soldered or welded connections between a fuse and conductive wires. Still further, the end caps 130*a* and 130*b* simplify the task of attaching conductive wires to a fuse as compared to soldering or welding, which require additional tools and materials to effectuate attachment.

As used herein, an element or step recited in the singular and proceeded with the word "a" or "an" should be understood as not excluding plural elements or steps, unless such exclusion is explicitly recited. Furthermore, references to "one embodiment" of the present invention are not intended to be interpreted as excluding the existence of additional embodiments that also incorporate the recited features.

While the present invention has been disclosed with reference to certain embodiments, numerous modifications, alterations and changes to the described embodiments are possible without departing from the sphere and scope of the present invention, as defined in the appended claim(s). Accordingly, it is intended that the present invention not be limited to the described embodiments, but that it has the full scope defined by the language of the following claims, and equivalents thereof.

The invention claimed is:

1. A fuse end cap comprising:

a mounting cuff defining a first cavity that receives an end of a fuse body, the end of the fuse body being electrically insulating;

a terminal defining a second cavity that receives a conductor, wherein the terminal is crimped about the conductor to retain the conductor within the second cavity; and a fastening stem that extends from the mounting cuff and into the second cavity of the terminal that receives the conductor.

2. The fuse end cap of claim 1, wherein the terminal is substantially tubular.

3. The fuse end cap of claim 1, wherein the mounting cuff is mounted to the fuse body by friction fit.

4. The fuse end cap of claim 1, wherein the mounting cuff is mounted to the fuse body by snap fit.

5. The fuse end cap of claim 1, wherein the mounting cuff is mounted to the fuse body by interference fit.

6. The fuse end cap of claim 1, wherein the mounting cuff and the terminal are coaxial.

7. The fuse end cap of claim 1, wherein the terminal is press fit onto the mounting stem.

8. The fuse end cap of claim 1, wherein the mounting cuff and the terminal are machined from a single, contiguous piece of conductive material.

9. The fuse end cap of claim 1, wherein the mounting cuff and the terminal are stamped from a single, contiguous piece of conductive material.

10. A fuse assembly comprising:

a first fuse end cap having a mounting cuff defining a first cavity and a terminal defining a second cavity;

a fastening stem that extends from the mounting cuff of the first fuse end cap and into the second cavity of the terminal;

a second fuse end cap having a mounting cuff defining a first cavity and a terminal defining a second cavity, and a fastening stem that extends from the mounting cuff of the second fuse end cap and into the second cavity of the terminal;

a fuse having a fuse body with a first end mounted within the first cavity of the first fuse end cap and a second end mounted within the first cavity of the second fuse end cap, wherein the first end of the fuse body and the second end of the fuse body are electrically insulating;

a first conductor having an end disposed within the second cavity of the first fuse end cap, wherein the terminal of the first fuse end cap is crimped about the end of the first conductor to secure the end of the first conductor within the second cavity of the first fuse end cap; and a second conductor having an end disposed within the second cavity of the second fuse end cap, wherein the terminal of the second fuse end cap is crimped about the end of the second conductor to secure the end of the second conductor within the second cavity of the second fuse end cap.

11. The fuse assembly of claim 10, wherein the ends of the first and second conductors are portions of respective insulated wires from which insulative coatings have been removed.

12. The fuse assembly of claim 10, wherein the ends of the first and second conductors are portions of a respective set of bare wires.

13. The fuse assembly of claim 10, wherein the first and second conductors electrically connect the fuse within a circuit.

14. The fuse assembly of claim 10, further comprising a protective wrapping covering the fuse, the first and second end caps, and the first and second conductors.

15. The fuse assembly of claim 14, wherein the protective wrapping is formed from a heat-shrinkable material.

16. The fuse assembly of claim 14, wherein the protective wrapping establishes an airtight seal around the fuse, the first and second end caps, and the first and second conductors.

17. The fuse assembly of claim 14, wherein the protective wrapping establishes a liquid-tight seal around the fuse, the first and second end caps, and the first and second conductors.

18. The fuse end cap of claim 10, wherein the terminal of each fuse end cap is press fit onto the fastening stem that extends from each fuse end cap.

19. The fuse end cap of claim 10, wherein each fuse end cap is machined from a single, contiguous piece of conductive material.

20. The fuse end cap of claim 10, wherein each fuse end cap is stamped from a single, contiguous piece of conductive material.

* * * * *